United States Patent [19]

Bennet

[11] 4,190,180

[45] Feb. 26, 1980

[54] LIQUID DISPENSER

[76] Inventor: Robert A. Bennet, 170 Sturbridge Rd., Easton, Conn. 06425

[21] Appl. No.: 971,384

[22] Filed: Dec. 20, 1978

[51] Int. Cl.[2] ..... B65D 37/00

[52] U.S. Cl. ..... 222/207; 222/211; 222/215

[58] Field of Search ..... 222/207, 211, 212, 215, 222/581, 209, 210; 401/11, 8

[56] References Cited

U.S. PATENT DOCUMENTS

| | | | |
|---|---|---|---|
| 2,078,862 | 4/1937 | Llewellyn | 222/581 |
| 2,162,920 | 6/1939 | Paul | 222/581 X |
| 2,752,069 | 6/1956 | Welsh | 222/207 |
| 2,979,236 | 4/1961 | Fahr | 222/211 X |
| 4,122,980 | 10/1978 | Laverty | 222/207 |

*Primary Examiner*—Allen N. Knowles

[57] ABSTRACT

The open neck of a vertical container of fluid is covered by a horizontal flexible diaphragm with an outer lip detachably engaging the periphery of the neck. A top disposed concave cup-like recess centrally disposed in the diaphragm has a hole in the bottom. A vertically elongated tube open at both ends extends through the hole and is sealed thereto, these ends being interconnected by a vertical bore. The bottom end extends into the fluid. The bore has a vertically elongated enlarged region which is disposed intermediate the top and bottom tube ends. The top tube end has a plurality of horizontal spaced conduits interconnecting the bore with the interior of the recess. A sphere in said region is slidable up and down therein, being moved by gravity to the bottom of the region when the tube is upright and being moved by gravity to the top of the region when the tube is inverted. Two sealing devices are disposed in the region adjacent the top and bottom thereof respectively. The sphere when disposed in the top of the region engages the first device and when disposed in the bottom of the region engages the second device, each device when engaged by said sphere forming a closed neck valve through which said liquid cannot pass.

6 Claims, 4 Drawing Figures

FIG. 1
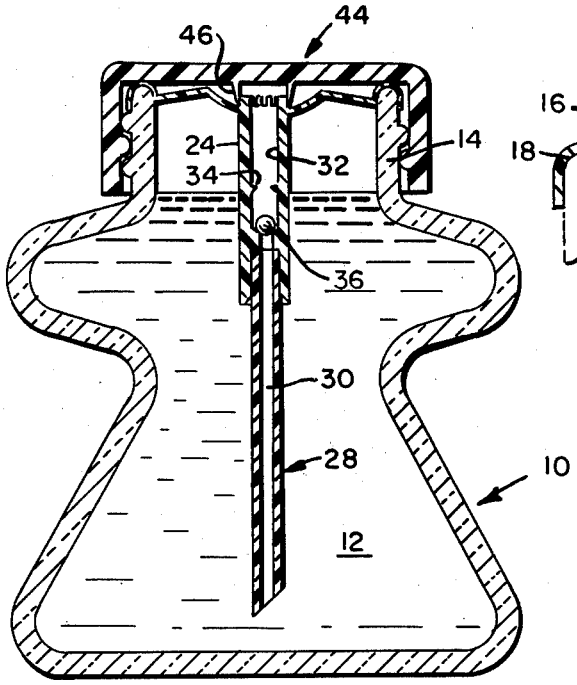
FIG. 2
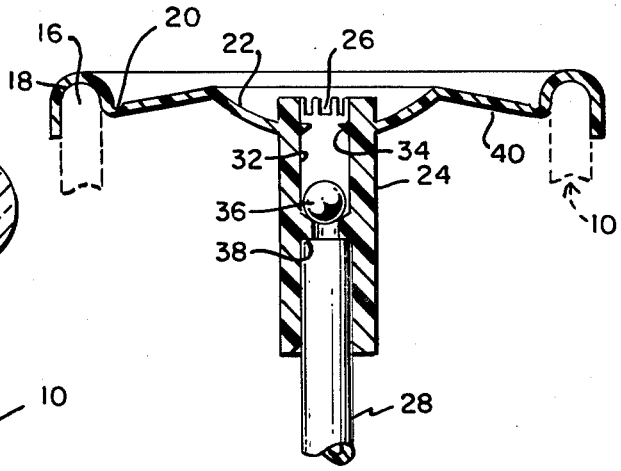
FIG. 3
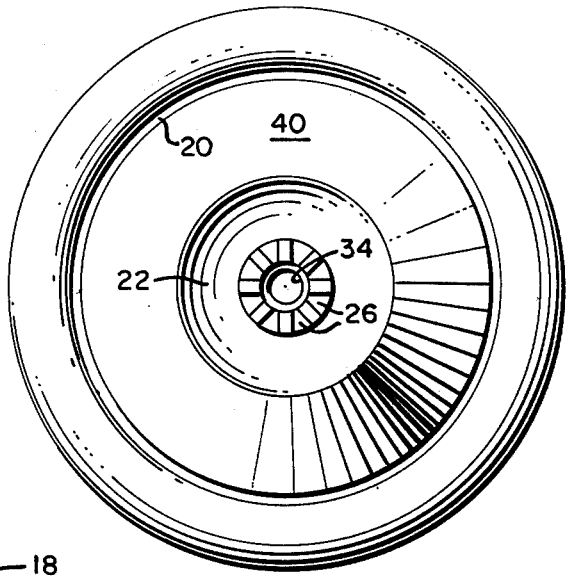
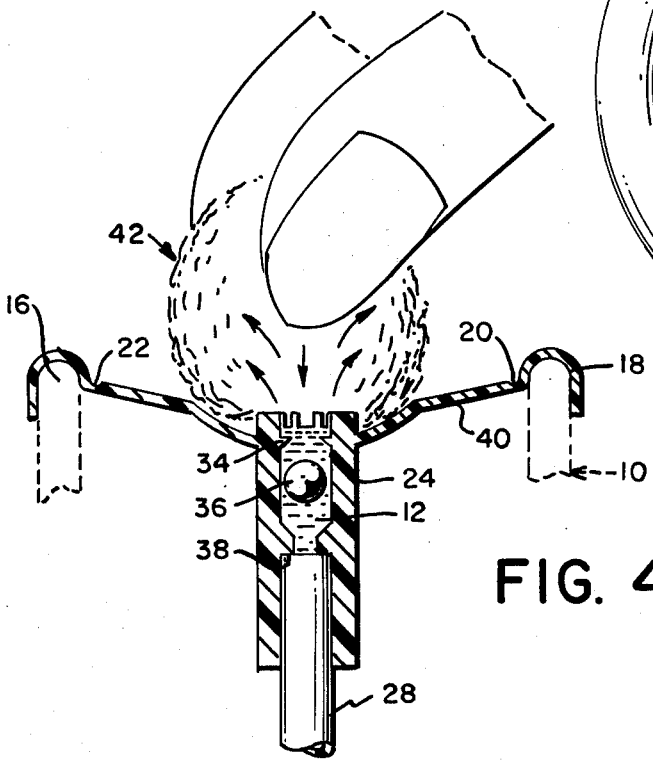
FIG. 4

LIQUID DISPENSER

THE PRIOR ART

Liquid finger nail polish remover is conventionally stored in a suitable container with a cap. After the cap is removed, the liquid is poured out of the container onto a cloth or other material for subsequent application to a nail containing polish in order to remove the polish. Alternatively, the container can have a removable cap with a brush secured thereto which normally is disposed in the liquid remover. When the cap is removed, the brush can be used to apply the remover to the nail as before. In either case, the cap is removed and resecured several times in the course of removing the polish from a nail whereby air is introduced repeatedly into the container and the liquid remover therein thickens and dries before being used up. The container must then be thrown away and the remaining contents wasted. In addition, the amount of liquid remover applied to the nail varies with each application and is frequently too little, requiring additional applications, or too much, whereby the excess must be removed rapidly to avoid discoloration or even cracking of the nail.

SUMMARY OF THE INVENTION

The present invention enables a user to dispense a metered amount of liquid sufficient to remove all the polish from a nail and insufficient to produce discoloration or cracking of the nail while at the same time minimizing the exposure to air of the liquid remover remaining in the container whereby the disadvantages set forth above are overcome.

To this end, the invention is directed toward a dispenser for use with a container of liquid having a vertical neck open at the top. The dispenser comprises a horizontal flexible diaphragm having downwardly extending peripheral lip adapted for detachable sealing engagement with the periphery of the open neck whereby the diaphragm covers the top of the neck. The diaphragm has a top disposed concave cup-like recess centrally disposed therein and inwardly spaced from said lip. The recess has a central hole at the bottom thereof.

A vertically elongated tubular element extends through said hole and is sealed thereto. The element has an open top end disposed above said hole in the recess, an open bottom end adapted to extend into said container below the level of said liquid, and a vertical bore interconnecting said top and bottom open ends. The bore has a vertically elongated enlarged region with a top and a bottom, said region being disposed intermediate the top and bottom ends of the element. The top end of the element has a plurality of horizontal spaced conduits interconnecting the bore with the interior of the recess.

A member is disposed in said region and is slidable up and down therein, said member being moved by gravity to the bottom of the region when the element is upright and being moved by gravity to the top of the region when the element is inverted.

First and second sealing means cooperate with said member and are disposed in the region adjacent the top and bottom thereof respectively, said member when disposed in the top of region engaging the first means and when disposed in the bottom of the region engaging the second means, each means when engaged by said member forming a closed check valve through which said liquid cannot pass.

Typically, said member is a sphere, said region is a vertical cylinder, said bore in horizontal cross section is circular in shape, and said diaphragm and said neck are circular in shape. Moreover the conduits extend radically outward through the top end of said element.

That portion of the diaphragm intermediate the top of the recess and the inner part of the lip extends radially outward and downwardly from the recess to the lip when the diaphragm is not flexed. The diaphragm portion, when manually flexed, extending radially outward and upward from the recess to said lip. The diaphragm returns automatically from flexed to unflexed position when the manual flexing action ceases. The diaphragm during its flexure produces a force of suction which, when the dispenser is in position in the container and the container is upright, opens the closed check valve and causes liquid to be drawn upward in the element and discharged via the top end of the element and said conduits into said recess.

In use, a cotton ball or the like is held covering the top end of the element and is pushed downward into the recess to flex the diaphragm. The liquid which typically is, but need not be, nail polish remover is then discharged into the ball and is absorbed therein for subsequent application and use. The same metered amount of liquid is discharged each time flexure occurs. When the downward pressure is released, the diaphragm returns automatically to the unflexed position.

The sphere normally engages the second sealing means and prevents air from entering the container. During flexure, the suction force momentarily lifts the sphere up whereby the liquid is discharged. Then the sphere falls downward by gravity and only sufficient air is introduced into the container via the channels and space between the second means and the descending sphere to replace the volume of liquid discharged before the sphere again engages the second means. Thus the amount of air introduced into the container during each dispensing action is minimized.

BRIEF DESCRIPTION OF THE DRAWINGS

FIG. 1 shows, in vertical cross section, the invention disposed in a container.

FIG. 2 is a vertical cross section of the invention per se.

FIG. 3 is a top plan view of the structure of FIG. 2.

FIG. 4 is a detail view illustrating the invention in use.

DETAILED DESCRIPTION OF PREFERRED EMBODIMENT

Referring now to FIGS. 1–4, a container 10 with nail polish remover liquid 12 therein has a vertical neck 14 with an open circular top end 16. A diaphragm has a downwardly extending peripherally disposed circular lip 18 which in cross section has the shape of an inverted U with an outer longer leg and an inner shorter leg. The lip snap fits onto end 16 with a liquid tight seal. A circular groove 20 in the top surface of the diaphragm disposed adjacent the inner leg of the lip permits the diaphragm to be flexed and automatically return to original unflexed position (as will be explained in more detail below) without disturbing the seal between the lip and the neck.

The diaphragm has a centrally disposed top concave recess 22 upwardly spaced from the groove and having a central hole in the bottom thereof. A vertical cylindral hollow tube 24 extends upwardly through the hole and is integral therewith. Tube 24 has a top open circular end disposed in the recess above the hole with a plurality of horizontally disposed radial channels 26 disposed in the top end and interconnecting the hollow interior of tube 24 with the interior of the recess. The bottom end of the tube 24 is open and a vertical hollow cylindrical dip tube 28 has its open top end fitted in liquid tight manner within the bottom end of tube 24. The bottom end of dip tube 28 lies along an inclined plane and extends into the liquid almost to the bottom of the container. The tube 28 has a vertical bore 30 which communicates with the larger diameter bore 32 in tube 24. Bore 32 actually forms an enlarged vertical cylindrically shaped region of bore 30.

A circular flange 34 disposed horizontally in bore 32 adjacent the top end has a central hole smaller in diameter than that of ball or sphere 36 which is movable up and down in bore 32. When the container is inverted, ball 36 moves by gravity into engagement with the flange 34. The bottom surface of the flange is contoured to conform to that portion of the sphere which engages it whereby a closed check valve is formed.

The top end of the dip tube has a seat 38 with a central opening smaller in diameter than that of sphere 36. When the container is vertically upright, the sphere 36 will fall by gravity into engagement with the seat. The top surface of the seat is contoured to conform to that portion of the sphere which engages it whereby another closed check valve is formed.

That radial portion 40 of the diaphragm which extends between the groove and the recess normally extends outward and downwardly from the recess to the groove when the diaphragm is in its normal unflexed state. When the diaphragm is flexed, portion 40 extends outward and upward from the recess to the groove.

When the container is ready for use, the sphere engages the seat, a seal is formed and liquid cannot pass upward through the seat.

When a user takes a cotton ball 42 and presses downward on the top end of tube 24 and the recess, the diaphragm is flexed. The suction force pulls the sphere upward and liquid is pulled up through the top open end of tube 24 and the channels to impregnate the cotton ball 40 with a metered amount of liquid. When the ball 40 is removed, the diaphragm automatically becomes unflexed. Some air flows downward through the tube and bore into the container to replace the volume of liquid dispensed. The sphere then falls downward by gravity to reseal the seat.

If the container is inverted, the seal formed between the sphere and the flange prevents liquid from leaking out of the container.

When the invention is not in use, a removal cap 44 screws onto the outer surface of the neck and covers the diaphragm. A downwardly extending hollow cylinder 46 secured to the bottom of the cap in its center engages the outer periphery of the top end of tube 24 to form yet another seal.

The sphere typically is of stainless steel while the diaphragm, tubes, seat and flange typically are formed from polypropylene. Other suitable materials can of course be used.

I claim:

1. A dispenser for use with a container of liquid having a vertical neck open at the top, said dispenser comprising:

a horizontal flexible diaphragm having a downwardly extending peripheral lip adapted for detachable sealing engagement with the periphery of the open neck whereby the diaphragm covers the top of the neck, said diaphragm having a top disposed concave cup-like recess centrally disposed therein and inwardly spaced from said lip, said recess having a central hole at the bottom thereof;

a vertically elongated tubular element extending through said hole and sealed thereto, said element having an open top end disposed above said hole in the recess, an open bottom end adapted to extend into said container below the level of said liquid, and a vertical bore interconnecting said top and bottom open ends, said bore having a vertically elongated enlarged region with a top and a bottom, said region being disposed intermediate the top and bottom ends of the element, the top end of the element having a plurality of horizontal spaced conduits interconnecting the bore with the interior of the recess;

a member disposed in said region and slidable up and down therein, said member being moved by gravity to the bottom of the region when the element is upright and being moved by gravity to the top of the region when the element is inverted; and first and second sealing means cooperating with said member and disposed in the region adjacent the top and bottom thereof respectively, said member when disposed in the top of the region engaging the first means and when disposed in the bottom of the region engaging the second means, each means when engaged by said member forming a closed check valve through which said liquid cannot pass.

2. The dispenser of claim 1 wherein said member is a sphere, said region is a vertical cylinder, said bore in horizontal cross section is circular in shape, said diaphragm and said neck are circular in shape and wherein said conduits extend radically outward through the top end of said element.

3. The dispenser of claim 2 wherein that portion of the diaphragm intermediate the top of the recess and the inner part of the lip extends radially outward and downwardly from the recess to the lip when the diaphragm is not flexed, said diaphragm portion, when manually flexed, extending radially outward and upward from the recess to said lip, the diaphragm returning automatically from flexed to unflexed position when the manual flexing action ceases, said diaphragm during flexing producing a force of suction which when the dispenser is in position in the container and the container is upright opens the closed check valve and causes liquid to be drawn upward in the element and discharged via the top end of the element and said conduits into said recess.

4. The dispenser of claim 3 wherein the first sealing means is a flange extending inwardly from the side wall, said flange having a first central opening smaller in diameter than the diameter of said sphere and having a bottom contour conforming to that portion of the sphere which engages the flange, the sphere engaging the first means to form a liquid tight seal therewith when the element is inverted.

5. The dispenser of claim 4 wherein said second sealing means has a second central opening smaller in diameter than the diameter of said sphere and having a top contour conforming to that portion of the sphere which engages the second sealing means, the sphere engaging the second means to form a liquid tight seal therewith when the element is upright.

6. The dispenser of claim 5 wherein the top end of the element is horizontal and the bottom end is inclined.

* * * * *